US006032604A

United States Patent [19]

Will

[11] Patent Number: 6,032,604

[45] Date of Patent: Mar. 7, 2000

[54] BOAT DOCKING DEVICE

[76] Inventor: Thomas R. Will, 155 Hickory St., Mt. Holly, N.J. 08060

[21] Appl. No.: 09/094,606

[22] Filed: Jun. 12, 1998

[51] Int. Cl.[7] ..... B63B 21/00

[52] U.S. Cl. ..... 114/230.11; 114/230.19

[58] Field of Search ..... 114/230.1, 230.11, 114/230.15, 230.19

[56] References Cited

U.S. PATENT DOCUMENTS

| | | | |
|---|---|---|---|
| D. 313,544 | 1/1991 | Scherer | D8/355 |
| 3,120,831 | 2/1964 | Fulton | 114/230 |
| 3,151,595 | 10/1964 | Stainbrook | 114/230 |
| 3,842,779 | 10/1974 | Jaynes | 114/230 |
| 4,073,255 | 2/1978 | Paul | 114/230 |
| 4,280,440 | 7/1981 | Barton | 114/230 |
| 4,462,329 | 7/1984 | Brushaber | 114/230 |
| 4,529,388 | 7/1985 | Jones et al. | 114/230.11 |
| 4,676,182 | 6/1987 | Chaiko | 114/230 |
| 5,269,044 | 12/1993 | Marion | 16/112 |
| 5,361,716 | 11/1994 | Cotton | 114/230.11 |
| 5,520,134 | 5/1996 | Walker | 114/230 |

*Primary Examiner*—Sherman Basinger
*Attorney, Agent, or Firm*—Norman E. Lehrer

[57] ABSTRACT

A device for aiding a person on a boat to dock the boat is disclosed. The device includes an elongated, flexible rod with a vertical section, a curved section extending from the vertical section, and a horizontal section which extends from the curved section. The horizontal section extends over the edge of the dock and has a spherical end. The rod also has a base member which mounts the rod to a dock and from which member the vertical section extends. The horizontal section or the end thereof may be grasped by a person on a boat when the boat is approaching the dock in order to facilitate maneuvering and eventually docking the boat.

10 Claims, 2 Drawing Sheets

BOAT DOCKING DEVICE

BACKGROUND OF THE INVENTION

The present invention is directed toward a boat docking device and more particularly, toward an apparatus and method for aiding a person on a boat to dock the boat.

Typically, in order to dock a boat, a person on the boat jumps onto the dock as the boat moves toward the dock. Obviously, such an act is dangerous, not only because the person jumping may not always be capable of making such a leap, but also because the boat may be pitching due to waves in the water, thereby creating hazardous conditions for the person jumping. Furthermore, the boat may be damaged when the person jumps to the dock. That is, the person on the boat will not have much control over the boat while he or she is attempting this maneuver. As a result, the boat may scrape against the dock.

Another method for docking a boat is to have someone on the dock throw a mooring line to a person on the boat. The problem with this method is that no one may be on the dock when a sailor decides to dock his or her boat.

A number of patents have addressed the problems discussed above. For example, U.S. Pat. No. 4,280,440 to Barton discloses a boat mooring apparatus which includes a flexible rod secured to a dock and extended over an edge of the dock. A weight is attached to the rod which bends the rod so that a person on a boat may grasp the rod. The rod helps to steady the person on the boat so that he or she may dock the boat. The problem with this rod, however, is that it is inconvenient. That is, a bar attached to the device and extending over the water must first be moved by the boat. This movement causes the bar to be rotated which causes the rod to be rotated so that the rod is now bent toward the boat and a person on the boat may now grasp the rod. A further problem is that the because the bar is pivotable, it may be knocked out of position so that when the boat approaches the dock, it may not come into contact with the bar.

U.S. Pat. No. 4,462,329 to Brushaber discloses a mooring line holding device which includes a rod which is secured to a dock and extends over an edge of the same. The rod is pivotable so that the rod may be placed in a position, before leaving the dock, to enable a person on a boat to pick up mooring lines which are hooked onto the rod, as the boat returns to the dock. The problem with this rod is that because it is pivotable, it may shift its position before the boat returns so that a person on the boat may not be able to reach the rod as the boat approaches the dock.

SUMMARY OF THE INVENTION

The present invention overcomes the deficiencies of the prior art described above. It is an object of this invention to provide a device which aids a person to dock a boat.

It is another object of the invention to provide a flexible device which extends over an edge of a dock but will not damage a boat if the boat inadvertently comes in contact with the device.

In accordance with the illustrative embodiments, demonstrating features and advantages of the present invention, there is provided an elongated, flexible rod with a vertical section, a curved section extending from the vertical section, and a horizontal section which extends from the curved section. The horizontal section extends over the edge of the dock and has an end with a spherical configuration. The rod also has a base member which mounts the rod to a dock and from which member the vertical section extends. The horizontal section or the end thereof may be grasped by a person on a boat when the boat is approaching the dock in order to dock the boat.

Other objects, features, and advantages of the invention will be readily apparent from the following detailed description of a preferred embodiment thereof taken in conjunction with the drawings.

BRIEF DESCRIPTION OF THE DRAWINGS

For the purpose of illustrating the invention, there is shown in the accompanying drawings one form which is presently preferred; it being understood that the invention is not intended to be limited to the precise arrangements and instrumentalities shown.

DETAILED DESCRIPTION OF THE PREFERRED EMBODIMENT

Figure 2:
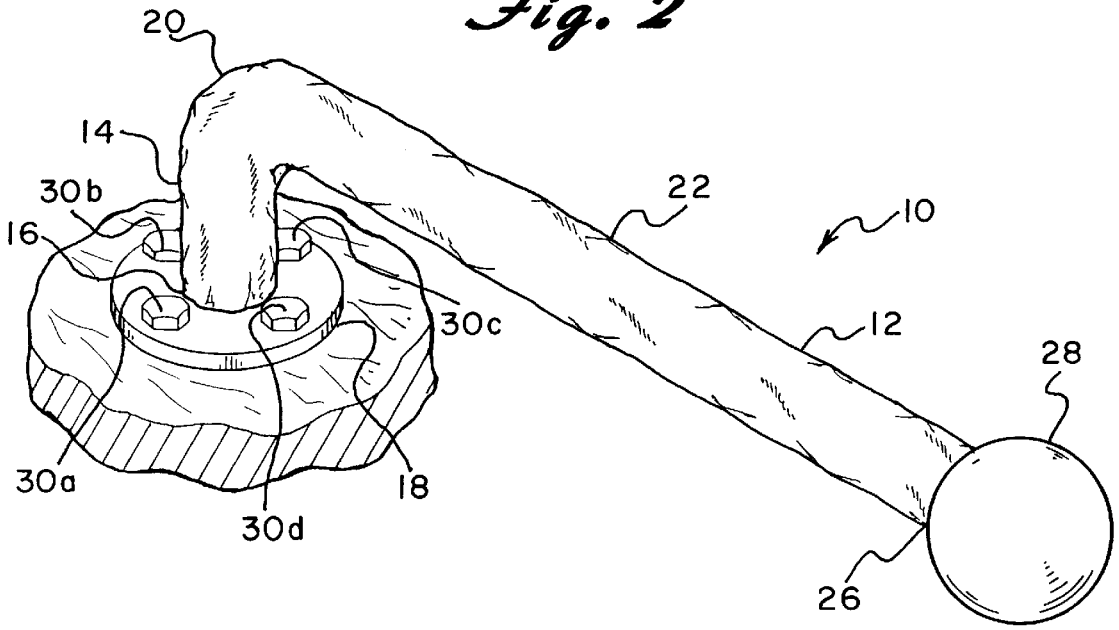
FIG. 2 is a perspective view of the present invention.
Figure 3:
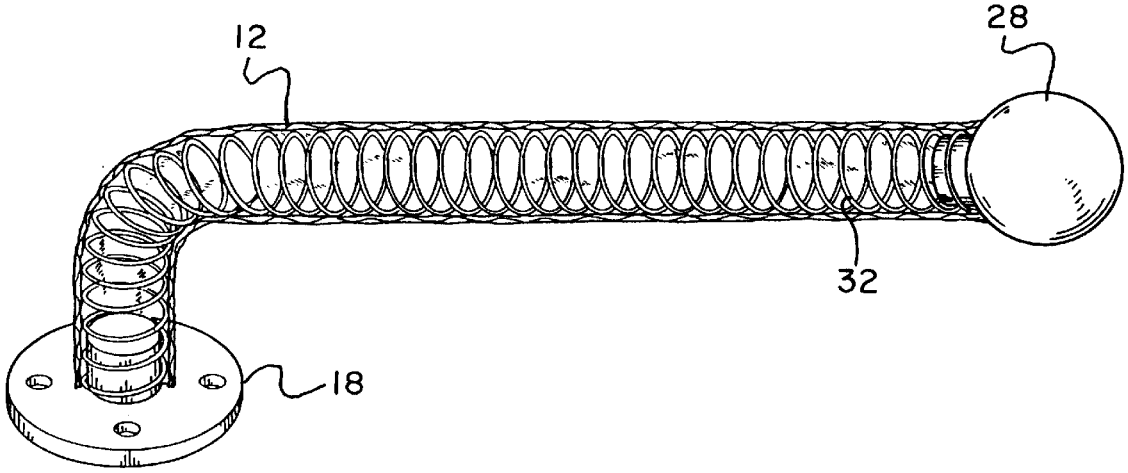
FIG. 3 is a view similar to FIG. 2 with portions cut away for illustration purposes.

Referring now to the drawings in detail wherein like reference numerals have been used throughout the various figures to designate like elements, there is shown in FIG. 2 a docking device constructed in accordance with the principles of the present invention and designated generally as 10.

Figure 1:
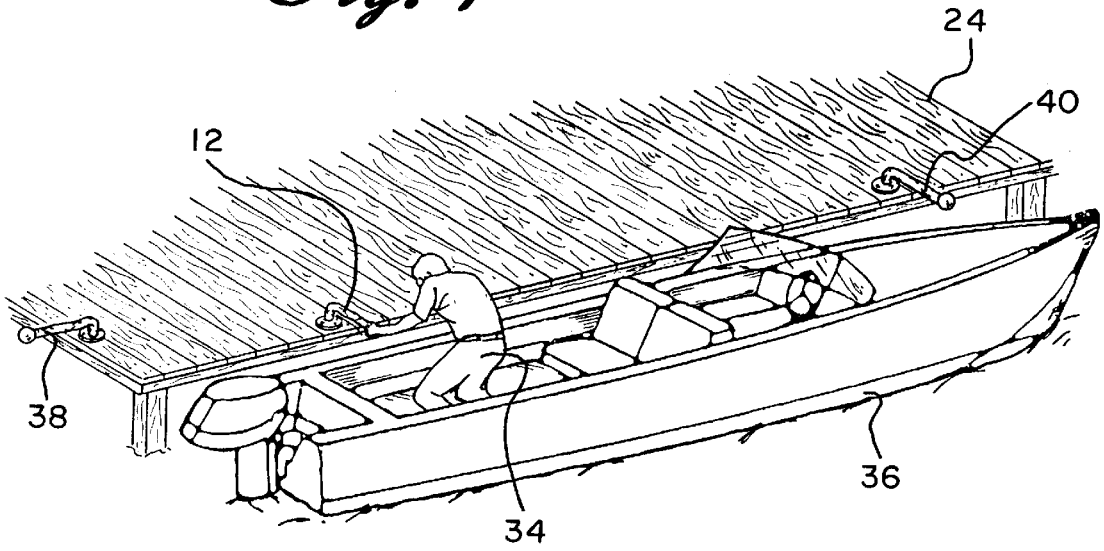
FIG. 1 is a schematic representation of the present invention attached to a dock and being used by a person.

The device 10 includes an elongated, flexible rod 12 with a vertical section 14 having an end 16 attached to a base member 18, a curved section 20 extending from the vertical section 14, and an elongated horizontal section 22 which extends from the curved section 20. The horizontal section 22 extends over the edge of a dock 24. (See FIG. 1.) The length of the horizontal section 22 is approximately 3 feet and extends from the curved section 20 at an angle of approximately 90 degrees. The horizontal section 22 has an end 26 which has a spherical configuration 28 which may be made from foam, rubber, or a similar type of material.

The base member 18 mounts the rod 12 to the dock 24 and is attached to the end 16 of the vertical section 14. The base member 18 consists of a plate with bolts 30*a–d* which are used to attach the base member 18 to the dock 24. The plate may be any size and shape and any type of fastening means may be used to secure the plate to the dock 24. The plate may also be made from metal or the like.

The rod 12 may be made from any type of flexible material such as rubber, plastic, or fiber glass. The rod 12 is generally hollow and has a spring member 32 housed therein. The spring member 32 may be made from metal or the like. The spring not only provides resiliency to the rod, it also allows the rod to maintain its position, as will be discussed below.

In order to use the present invention, a person 34 on a boat 36 may grasp the horizontal section 22 of the rod 12 or the ball 28 as the boat 36 approaches the dock 24 in order to facilitate maneuvering and eventually docking the boat 36. (See FIG. 1.) The ball 28 at the end 26 of the horizontal section 22 may itself be grasped. However, the ball 28 may also aid the person 34 if the horizontal section 22 is grasped because the ball 28 will act as a stop if the person's hand slips and slides along the length of the horizontal section 22.

Figure 4:
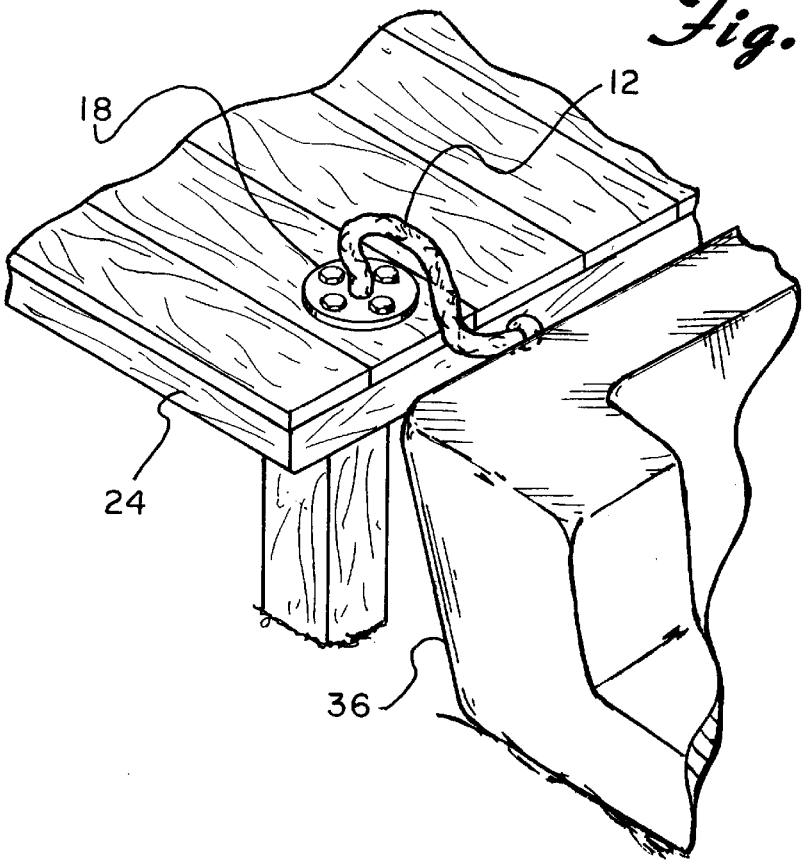
FIG. 4 is a perspective view of the present invention being flexed when a boat inadvertently comes into contact with it.

The rod 12 is flexible, so it will not damage the boat 36 if the rod 12 accidentally contacts the boat 36. The rod 12 will simply flex out of the way. (See FIG. 4.) Yet, while the rod 12 is flexible, it is not pivotable. That is, the horizontal section 22 of the rod 12 may flex when a boat 36 comes into contact with it accidentally. However, due to the action of the spring member 32 within the rod 12, the rod 12 will always return to its original position (see FIG. 1) once the boat moves away. Therefore, the rod 12 is always easily accessible to a person on a boat. Also, a plurality of rods may be attached to a dock. See, for example, rods 38 and 40 in FIG. 1.

The present invention provides a safe, inexpensive, and simple way for a person to dock a boat. That is, a person on the boat avoids the danger of having to jump from the boat to the dock. Furthermore, the present invention also avoids the necessity of having a person present on the dock to aid in docking the boat.

The present invention may be embodied in other specific forms without departing from the spirit or essential attributes thereof and accordingly, reference should be made to the appended claims rather than to the foregoing specification as indicating the scope of the invention.

I claim:

1. A boat docking device for aiding a person on a boat to dock a boat comprising:

an elongated, flexible rod having a vertical section, a curved section extending from said vertical section, and an elongated horizontal section extending from said curved section at an angle of approximately 90 degrees, said horizontal section having an end which may be grasped by a person on a boat, said rod being hollow and containing a spring member therein, said spring member normally maintaining said horizontal section in a horizontal position and means attached to said vertical section for mounting said rod to the dock.

2. The boat docking device as claimed in claim 1 wherein said rod is comprised of a rubber-like material.

3. The boat docking device as claimed in claim 1 wherein said end of said horizontal section has a spherical cover.

4. The boat docking device as claimed in claim 1 wherein said mounting means includes a metal plate with screws.

5. The boat docking device as claimed in claim 1 wherein the length of said horizontal section is approximately 3 feet.

6. A method for docking a boat comprising the steps of:

providing an elongated, flexible rod having a vertical section, a curved section extending from said vertical section, and an elongated horizontal section extending from said curved section at an angle of approximately 90 degrees, said horizontal section having an end extending over an edge of a dock, said rod being hollow and containing a spring member therein and means attached to said vertical section for mounting said rod to the dock and grasping said horizontal section of said rod when the boat approaches the dock in order to draw the boat closer to the dock.

7. The method as claimed in claim 6 wherein said rod is made from rubber.

8. The method as claimed in claim 6 wherein said end of said horizontal section has a spherical cover.

9. The method as claimed in claim 6 wherein said mounting means includes a metal plate with bolts.

10. The method as claimed in claim 6 wherein the length of said horizontal section is approximately 3 feet.

* * * * *